United States Patent [19]

Vologni et al.

[11] 4,440,467

[45] Apr. 3, 1984

[54] BULB SOCKET AND COVER ASSEMBLY

[76] Inventors: Armando Vologni; Giorgio Vologni, both of Via Bizet no 2 - 42100, Reggio Emilia, Italy

[21] Appl. No.: 380,378

[22] Filed: May 20, 1982

[30] Foreign Application Priority Data

May 29, 1981 [IT] Italy ..... 34853/81[U]

[51] Int. Cl.[3] ..... H01R 13/00

[52] U.S. Cl. ..... 339/154 L

[58] Field of Search ..... 339/154 A, 154 L, 25, 339/154 R, 155 L, 160, 161, 162, 153

[56] References Cited

FOREIGN PATENT DOCUMENTS 2817122 10/1979 Fed. Rep. of Germany ... 339/154 L 2901164 7/1980 Fed. Rep. of Germany ... 339/154 A

*Primary Examiner*—Joseph H. McGlynn

*Assistant Examiner*—Steven C. Bishop

*Attorney, Agent, or Firm*—Sughrue, Mion, Zinn, Macpeak & Seas

[57] ABSTRACT

A socket assembly for a small light bulb adapted to be secured in a socket for a larger standard light bulb is comprised of a base member having external threads adapted to be secured in a standard light socket. The base member has tubular socket of smaller diameter extending coaxially from one end thereof which is provided with internal and external threads. A cover support disc having a central aperture is secured around the tubular socket in engagement with the base member by means of a threaded sleeve in engagement with the external threads on the tubular socket. A small light bulb is threaded into the hollow tubular socket and a cover member which may be of one or two parts is detachably connected to the cover support disc. The cover member may be of translucent colored material.

3 Claims, 1 Drawing Figure

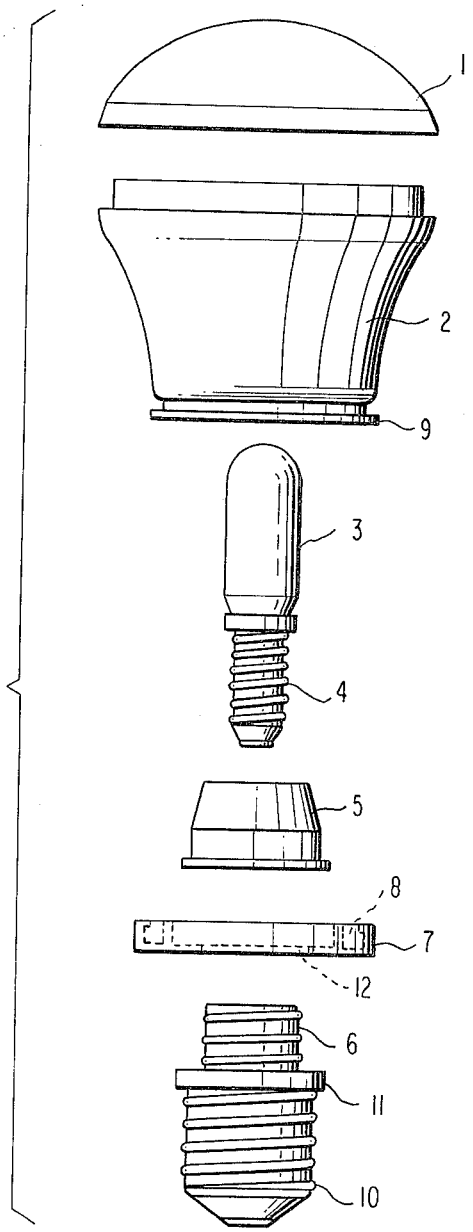
1
2
9
3
4
5
8
7
12
6
11
10

BULB SOCKET AND COVER ASSEMBLY

BACKGROUND OF THE INVENTION

The present invention is directed to a bulb socket and cover assembly adapted to be secured in a standard light bulb socket and adapted to utilize a bulb considerably smaller than a standard light bulb. The bulb socket is secured to an adapter base having a detachable, translucent cover which may be of different colors and which is detachable to provide access to the bulb.

Lighting displays utilizing a plurality of light bulbs have been used for years in conjunction with various advertisements and decorative displays. Such lighting displays are also common in amusement parks wherein a plurality of light bulbs are used, not only on advertising signs, but are also used to outline various booths such as shooting ranges and the like as well as moving amusements such as merry-go-rounds, dodgems, and other rides. Such displays generally utilize standard light bulbs which are secured in sockets directly secured to the signs, booths, or rides. Such lighting displays often utilize hundreds or even thousands of bulbs which are relatively expensive and it is necessary to be able to replace the burned out bulbs as soon as possible to maintain the lighting displays in an attractive condition. As a result, it is necessary to be able to quickly change the light bulbs. Often, the lighting displays utilize a plurality of light bulbs of different colors thereby creating the need for a large inventory of light bulbs of different colors.

Since most of the lighting displays utilize standard light bulbs having a threaded base member of one diameter and a bulbous glass portion having a diameter which is considerably larger than the base, the storage of a large number of light bulbs will take up a considerable amount of room. In order to avoid these and other problems, some lighting devices have been introduced utilizing small volume bulbs which are not colored and which are covered by a casing independent of the bulb and socket assembly. The casings are generally detachable for ease of bulb replacement and are of a translucent colored material thereby reducing the number of spare bulbs which must be kept in stock. However, most of these designs are custom made and are not compatible with the existing standard sockets already in place on the signs or rides in amusement parks or the like. Therefore, in order to utilize the new design it is necessary to modify the entire existing lighting system with a significant loss of time and at a very high cost.

SUMMARY OF THE INVENTION

The present invention provides a new and improved bulb socket and cover assembly adapted to be utilized directly with a standard light bulb socket in lieu of the standard light bulb with no modification necessary with respect to the standard sockets and the mounting thereof.

The present invention provides a new and improved bulb socket and cover assembly comprising an externally threaded base member adapted to be secured in a standard light bulb socket, a hollow tubular socket coaxially secured to said base member and having a diameter less than said base member with internal and external threads thereon, a cover support disc having a central aperture adapted to be placed over said tubular socket in engagement with said base member, a threaded sleeve engageable with the external threads on said tubular socket for securing said disc against said base member, said internal threads of said tubular socket being adapted to receive a light bulb having a base with a diameter smaller than the diameter of said base member, cover means of translucent material adapted to fit over a light bulb in said tubular socket and complimentary fastening means on said cover means and said disc for detachably connecting said cover means to said disc. The cover means may be comprised of a unitary globe-type member or a two-part assembly having a tubular portion and an end cap detachably connected thereto.

The foregoing and other objects, features and advantages of the invention will be apparent from the following more particular description of a preferred embodiment of the invention as illustrated in the accompanying drawings.

BRIEF DESCRIPTION OF THE DRAWING

The single drawing FIGURE is an exploded side elevation view of the bulb, socket and cover assembly according to the present invention.

DETAILED DESCRIPTION OF THE INVENTION

The bulb, socket and cover assembly according to the present invention is comprised of a cover member or globe which may be of one piece or two pieces as illustrated in the drawing. The cover or globe as illustrated is comprised of an annular casing 2 and a complementary end cap 1 which are adapted to be detachably connected to each other by any suitable means such as a press fit, an interfitting snap-type connection, a bayonet-type connection or a screw thread-type connection. The two parts of the cover may be of opaline or translucent material of any desired color with the color varying between the casing 2 and the end cap 1. The configuration of the cover or globe may vary widely depending upon the decorative end effect desired.

The bulb 3 having a base member 4 is considerably smaller than a standard light bulb with the glass part of the bulb having a diameter substantially equal to the diameter of the base member. Once again, the exact configuration of the bulb 3 may vary as long as the bulb is considerably smaller than the standard light bulb and is compatible with the base assembly to be described hereinafter.

The base assembly which is adapted to be secured in a standard light socket in lieu of a standard size light bulb is comprised of a base member 10 having external threads thereon adapted to mate with the internal threads of the standard light bulb socket. The base member 10 is provided with a hollow tubular socket 6 secured thereto and extending in a coaxial manner relative thereto. An annular support flange 11 is secured to the base member 10 surrounding the tubular socket 6. A cover support disc 7 is provided with a central aperture 12 which allows the disc 7 to be placed in a coaxial manner over the tubular socket 6 into engagement with the annular flange 11. An internally threaded sleeve 5 is adapted to be mated with the external threads on the tubular socket 6 to secure the cover support disc 7 against the annular flange 11. The cover support disc 7 may be made of a material which is sufficiently rigid to support the cover assembly 1 and 2 but which is also elastically deformable. An annular slot 8 is formed in the disc 7 into which the lip 9 on the cover casing 2 may be inserted. The base 4 of the bulb 3 is adapted to be threaded into engagement with the internal threads of the hollow tubular socket 6.

From the foregoing description of the various elements, the assembly thereof is obvious. The disc 7 is placed about the tubular socket 6 in engagement with the flange 11. The threaded sleeve 5 is then screwed onto the threaded socket 6 to secure the disc 7 in position. The bulb 3 is then screwed into the tubular socket 6 and the lip 9 on the casing 2 is fitted into the slot 8 of the support disc 7 by deforming the lip on the disc. If the cover or globe is of one-piece construction, the assembly is then completed. If the cover or globe is of two parts as shown in the drawing, the end cap 1 is then secured to the casing 2 by any suitable interconnection means. Since frequent insertion and removal of the casing 2 in the slot 8 of the disc 7 might ultimately have an adverse effect on the disc 7, it is preferable to construct the cover or globe in two pieces as illustrated. As mentioned previously, the use of the two-piece cover or globe enables the two parts to be of different colors to add to the decorative effect.

Thus, the present application provides a bulb socket and cover assembly which allows the use of light bulbs smaller than conventional light bulbs and allows the use of non-colored light bulbs since any decorative coloring can be achieved through the translucent cover or globe. In addition to the globe being of opaline or translucent material, it is also possible to combine various types of reflectors and/or refractors with the globe to achieve a greater decorative effect.

While the invention has been particularly shown and described with reference to a preferred embodiment thereof, it will be understood by those in the art that various changes in form and details may be made therein without departing from the spirit and scope of the invention.

What is claimed is:

1. A bulb socket assembly comprising a cylindrical base member having external threads thereon adapted to mate with the threads of a standard light bulb socket, a hollow tubular socket extending coaxially from one end of said base member and having a diameter substantially less than the diameter of said cylindrical base member, said hollow tubular socket having external threads thereon, an apertured cover support disc surrounding said hollow tubular socket, an internally threaded sleeve member threadingly engaged with said external threads on said hollow tubular member for securing said cover support disc in engagement with said base member and cover means detachably connected to said cover support disc.

2. A bulb socket assembly as set forth in claim 1, wherein said cover means is provided with an annular lip and said disc is comprised of an elastically deformable material having an annular groove therein complementary to said lip whereby said lip may be forced into said groove and held therein.

3. A bulb socket assembly as set forth in claim 2, wherein said cover member is comprised of a first hollow annular casing part having said lip thereon and an end cap detachably connected to said casing, said cover means being comprised of translucent colored material.

* * * * *